US005868292A

United States Patent [19]

Stephens et al.

[11] Patent Number: 5,868,292

[45] Date of Patent: Feb. 9, 1999

[54] FRAME CARRIER FOR CHILDREN

[75] Inventors: William B. Stephens, Boulder; Paul F. Fair; James S. Panzarella, both of Denver, all of Colo.

[73] Assignee: Gerry Baby Products, Thornton, Colo.

[21] Appl. No.: 552,947

[22] Filed: Nov. 3, 1995

[51] Int. Cl.[6] ..... A47D 13/02

[52] U.S. Cl. ..... 224/161; 224/155; 224/633; 224/638

[58] Field of Search ..... 224/155, 160, 224/161, 628, 633, 637, 638, 262, 636; D3/214

[56] References Cited

U.S. PATENT DOCUMENTS

| | | | |
|---|---|---|---|
| D. 286,227 | 10/1986 | Ellis | D3/214 |
| 3,035,747 | 5/1962 | Ullrich, Jr. . | |
| 3,162,343 | 12/1964 | Anderson | 224/160 |
| 3,938,718 | 2/1976 | Madison | 224/262 |
| 3,989,173 | 11/1976 | Gebhard | 224/161 X |
| 4,018,370 | 4/1977 | Wood . | |
| 4,317,438 | 3/1982 | Sato et al. | 200/556 |
| 4,676,418 | 6/1987 | Lowe | 224/215 |
| 4,746,044 | 5/1988 | Arvizu et al. | 224/161 |
| 4,923,104 | 5/1990 | Rice et al. | 224/155 |
| 5,004,135 | 4/1991 | Dufournet et al. | 224/262 X |
| 5,016,794 | 5/1991 | Beagle, Jr. | 224/211 |
| 5,020,709 | 6/1991 | Hoaglan | 224/155 |
| 5,046,651 | 9/1991 | Dagdagan | 224/155 |
| 5,205,451 | 4/1993 | Manzer | 224/161 |
| 5,397,870 | 3/1995 | Noro | 200/335 |
| 5,509,590 | 4/1996 | Medeiros, Jr. et al. | 224/161 |

*Primary Examiner*—Renee S. Luebke
*Attorney, Agent, or Firm*—Robert G. Crouch; Chrisman, Bynum & Johnson, P.C.

[57] ABSTRACT

A frame carrier including a soft body portion and a frame formed of a resin material. The soft body portion includes a front portion, a back portion, side portions and a seat portion connected to the back portion. The seat portion includes a forward end with an adjustment strap attached to the frame wherein the adjustment of the length of the adjustment strap may be used to adjust the height of the seat portion. A pivoted leg stand is provided including a pivot connection which defines two predetermined positions for the leg stand. The pivot connection includes cooperating cam and detent members wherein the two positions for the leg stand are defined by movement of the cam relative to the detent. The carrier further includes an adjustable waist belt including a pair of clips engaged in vertically extending slots in the frame. A plurality of mounting points for the clips are defined along the slots to thereby define different height positions for the waist belt.

13 Claims, 9 Drawing Sheets

FRAME CARRIER FOR CHILDREN

BACKGROUND OF THE INVENTION

The present invention relates generally to child carriers and, more particularly, to a child carrier including a frame and a soft body portion mounted on the frame for supporting a child.

Carriers for carrying small children either in front of or in back of an adult have become increasingly popular as an alternative to holding a child in one's arms or placing a child in a stroller. Two types of carriers available include soft carriers which are generally formed of soft material and include straps for extending around an adult's shoulders to support the carrier, and frame carriers which include a rigid frame and a child supporting body portion mounted to the frame wherein shoulder straps and a waist belt are provided attached to the frame such that the weight of the carrier is distributed between an adult's shoulders and waist. Frame carriers are designed to be supported on a persons back and, as a result of distributing the weight between upper and lower portions of the persons back, the frame carrier is well suited for long term use.

Generally, a frame carrier is designed to engage a user at specific points on the back, such as at the shoulders and at the hips. Since carriers are generally used by more than one person, such as by both parents, the frame of the carrier must be designed such that it will be comfortable on users of different sizes. Accordingly, it is desirable to have a frame carrier which may be easily and quickly adjusted to accommodate a large range of body sizes for users.

In providing adjustments for supporting a carrier frame on the user, it is desirable to maintain the center of gravity for a child supported in the carrier as close as possible to the center of gravity for the user supporting the carrier. This is best accomplished by providing a substantially constant shoulder strap position regardless of the user, and adjusting the height of the waist belt in accordance with the height of the user. Maintaining the center of gravity of the child as close as possible to that of the adult minimizes the need of the adult to compensate for the weight of the child by leaning forward excessively, and further minimizes the inertial load associated with turning side to side or stopping.

A further desirable aspect for a child carrier includes providing an adjustment whereby a seat for a child in the carrier may be adjusted to accommodate the size of the particular child. Adjusting the seat for the size of the child insures that the child is provided with sufficient support for sitting and sleeping, and preferably reduces movement and inertial momentum as the adult supporting the carrier moves around.

SUMMARY OF THE INVENTION

The present invention provides a frame carrier for carrying children wherein the carrier includes a soft body portion for supporting a child and a relatively rigid frame formed of a resin material, such as a molded plastic, supporting the soft body portion. The frame includes a central spine portion having an upper end portion and a lower end portion.

The upper end portion is formed with rearwardly extending wing portions which extend along and support the soft body portion. The wing portions extend in cantilever relation from the upper end portion, and pockets defined along opposing sides of the body portion receive the wing portions therethrough.

The upper end portion defines a generally triangular shape including an upper cross bar. The soft body portion includes a seat portion having one end attached to a back portion of the soft body portion and a front end connected to a strap which extends through a slot in the cross bar. A free end of the strap is engaged with a ladder lock strap connector attached to the seat portion wherein drawing the strap through the ladder lock will cause the height of the seat portion to increase and loosening the strap will cause the seat height to decrease. In this manner, the height of the seat may be adjusted to accommodate different size children.

The lower end portion of the frame is formed with a generally Y-shape configuration. A pair of shoulder straps extend from the upper end portion of the frame downwardly to connection points along the branches of the Y for the lower end portion. In addition, each of the branches of the lower end portion include vertically extending slots defining mounting points for a waist belt. The waist belt includes mounting portions adapted to extend through the slots wherein the mounting portions are defined by straps attached to resilient clips. The clips movably engage within the slots and means are provided along the slots defining predetermined locations for receiving the clips. The predetermined locations are located vertically along the slots whereby moving the clips to different locations will adjust the vertical position of the waist belt relative to the frame.

In a further aspect of the invention, a leg stand is provided for supporting the frame in an upright position on a horizontal surface. A pivot connection is provided attaching the leg stand to the frame for pivotal movement. A pair of cooperating members are provided including a cam and a detent cooperating with each other to locate the leg stand in two predetermined positions. The cam pivots with the leg stand and rotates relative to the detent. The detent is spring biased toward the cam to provide an effective stop for either position of the leg stand.

Therefore, it is an object of the present invention to provide a carrier including a soft body portion and a resin frame for supporting the carrier on the back of a user.

It is a further object of the invention to provide a carrier having a frame supported on a user by shoulder straps and a waist belt wherein the waist belt may be adjusted to different vertical positions relative to the frame.

It is yet another object of the invention to provide a carrier having a frame and including a leg stand pivotally connected to the frame wherein two cooperating members define predetermined positions for the leg stand.

It is a further object of the invention to provide a child carrier including a soft body portion and a frame wherein an adjustment strap is provided for a seat portion of the body portion to adjust the height of the seat portion relative to the frame.

Other objects and advantages of the invention will be apparent from the following description, the accompanying drawings and the appended claims.

DETAILED DESCRIPTION OF THE PREFERRED EMBODIMENT

Figure 1:
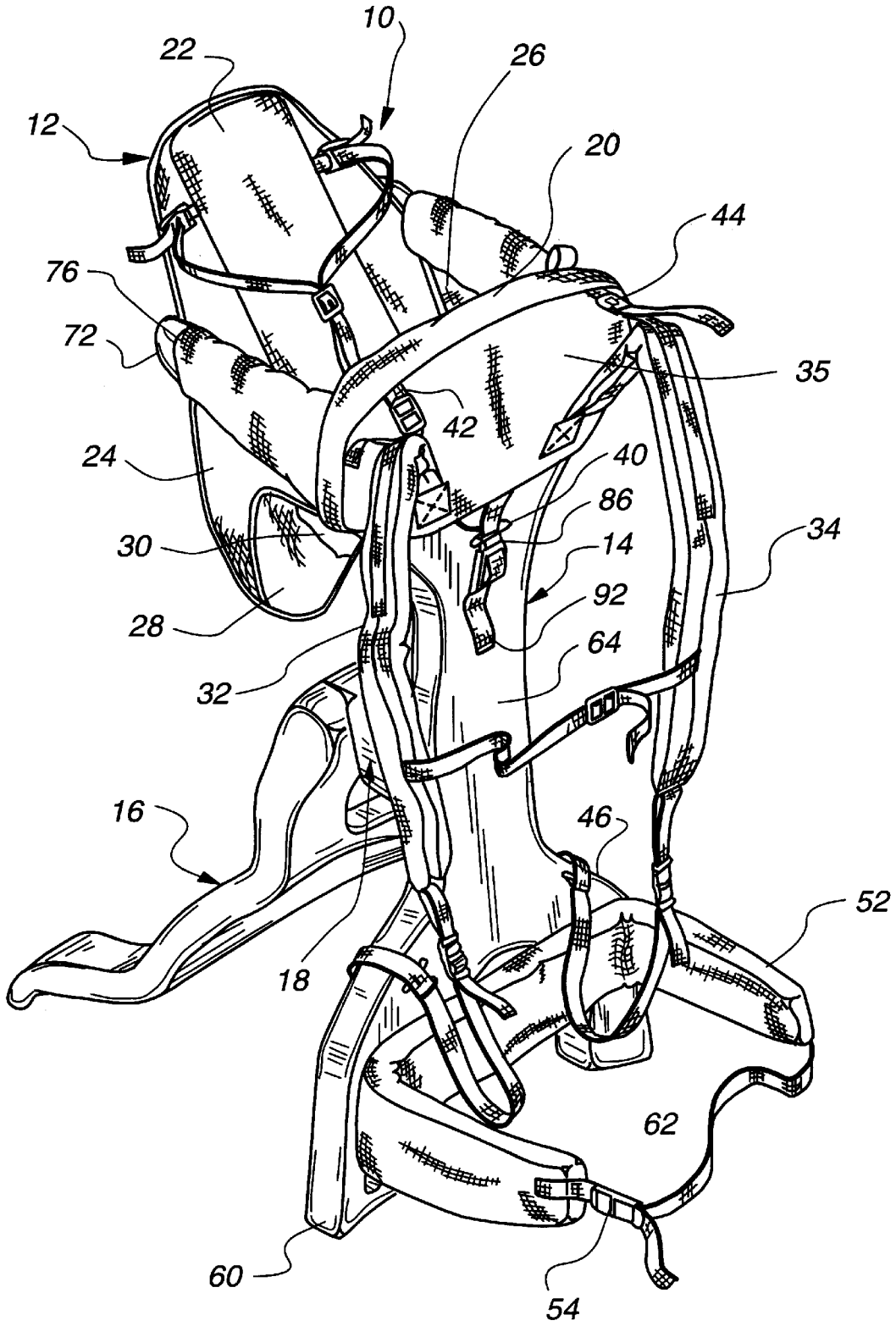
FIGS. 1 and 2 are perspective views of the frame carrier of the present invention.
Figure 2:
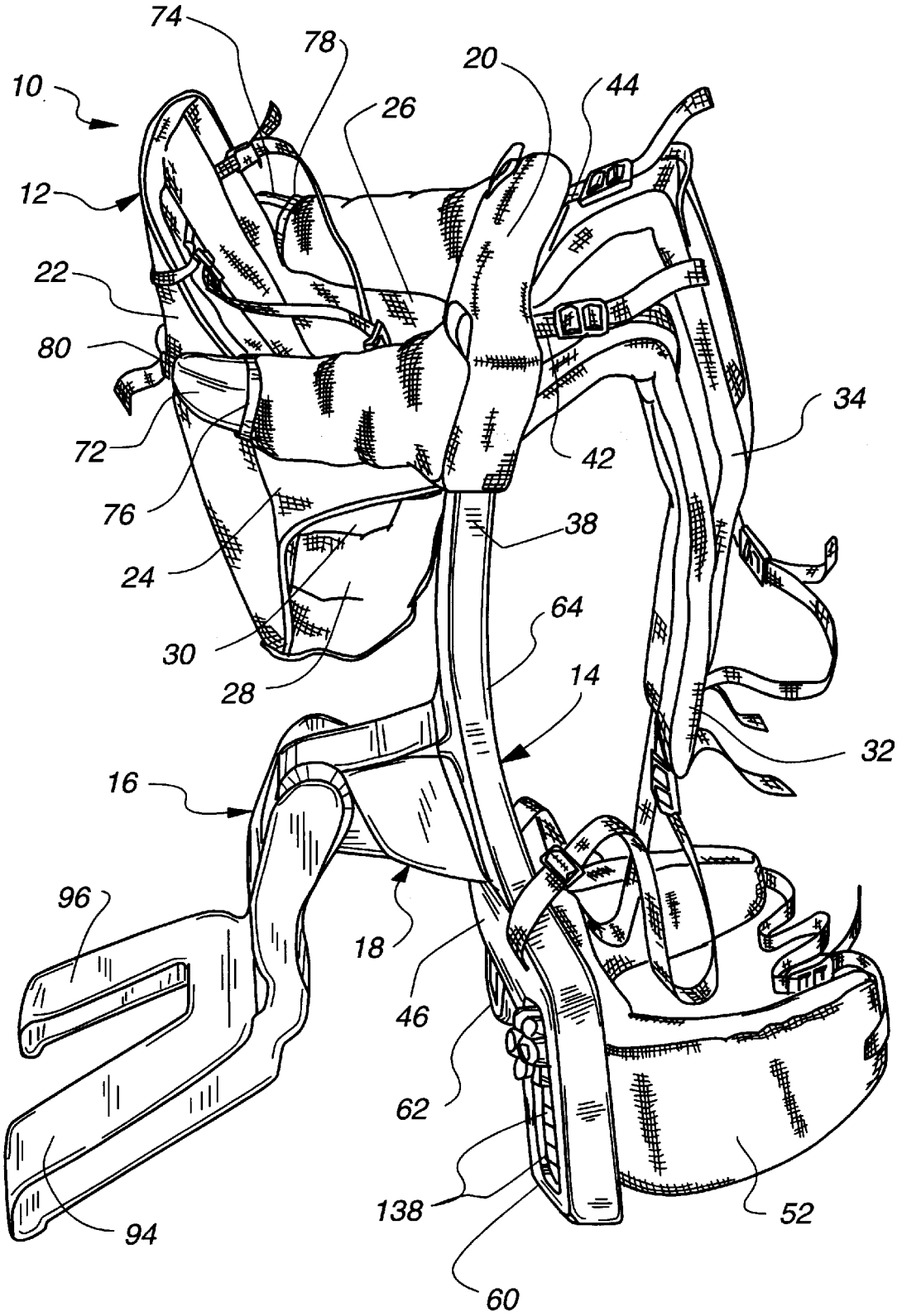

Referring initially to FIGS. 1 and 2, the frame carrier 10 of the present invention generally includes a soft body portion 12 supported on a frame 14 wherein the frame is preferably formed of a resin material such as a molded plastic. A leg stand 16, which is also preferably formed of a resin material, is supported for pivotal movement relative to the frame 14 on a hinge extender 18 rigidly attached to the frame 14.

The soft body portion 12 includes a front portion 20, a back portion 22, side portions 24, 26 connecting the front portion 20 and back portion 22, and a seat portion 28 connected to the back portion 22 for supporting a child. The seat portion 28 and back portion 22 define a leg opening area 30 for receiving a child's legs extending therethrough.

A pair of shoulder straps 32, 34 are also provided attached to a padded frame cover 36 which extends over an upper portion 38 (see FIG. 3) of the frame 14 Auxiliary straps 42, 44 extend between an upper medial location on the shoulder straps 32, 34 and an upper edge of the front portion 20, and the length of the auxiliary straps 42, 44 are adjustable to thereby adjust the distance between the shoulders of a person wearing the carrier 10 and the upper end portion 38 of the carrier. The auxiliary straps 42, 44 define load levers for facilitating distributing the weight of a child in the carrier.

In addition, lower ends of the shoulder straps 32, 34 are attached to a lower end portion 46 of the frame at respective slots 48, 50. The lower ends of the shoulder straps 32, 34 are also preferably adjustable by a conventional adjustment mechanism, such as a ladder lock connector.

A waist belt 52 is provided and includes a quick disconnect connector 54 providing means for adjusting the circumference of the waist belt 52. The waist belt 52 is engaged with the lower end portion 46 of the frame 14 at elongated vertical slots 56, 58 formed in lower extensions 60, 62 of the lower end portion 46. The connection between the waist belt 52 and the lower end portion 46 will be described in greater detail below.

Figure 3:
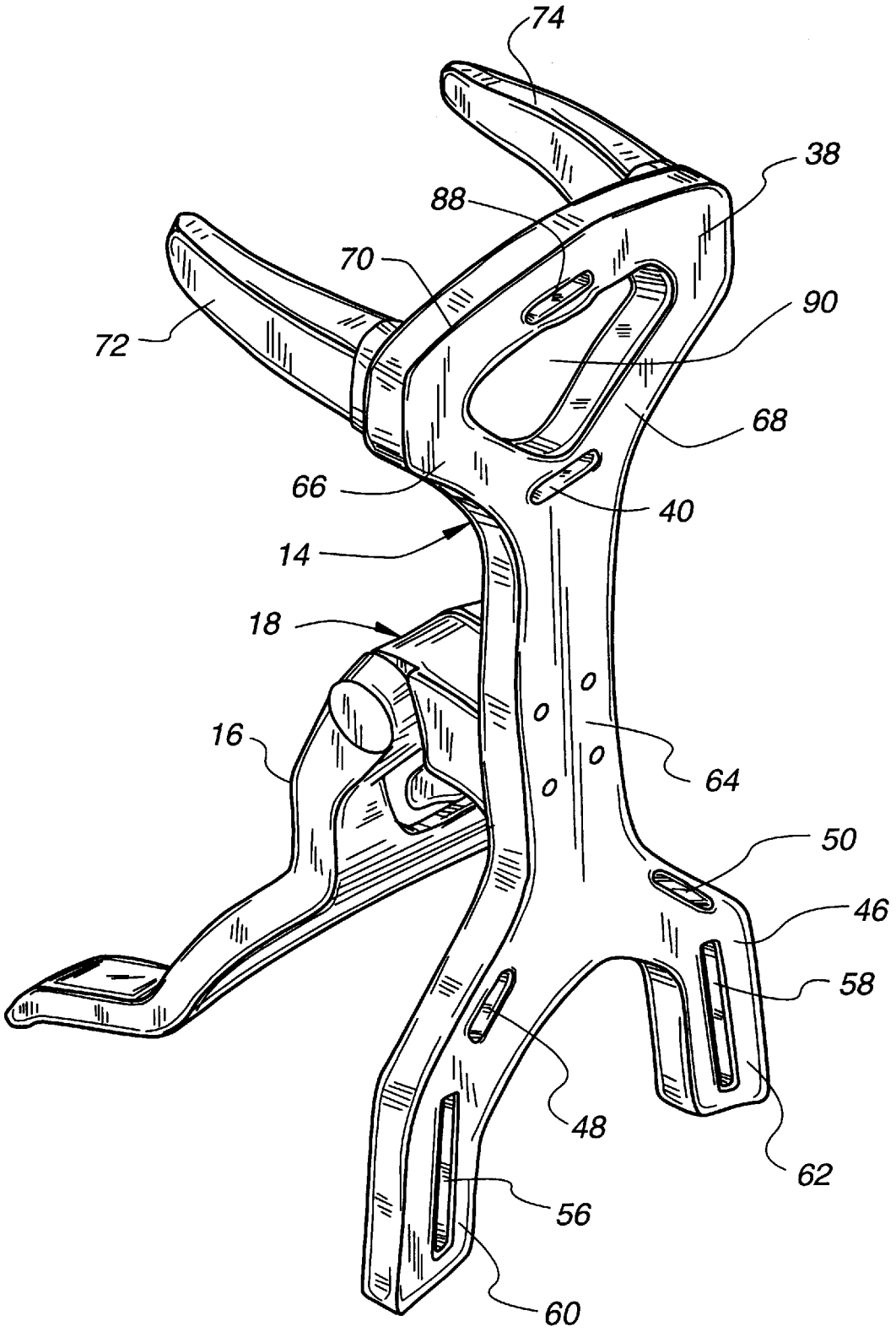
FIG. 3 is a perspective view of the frame for the frame carrier with the soft body removed.
Figure 5:
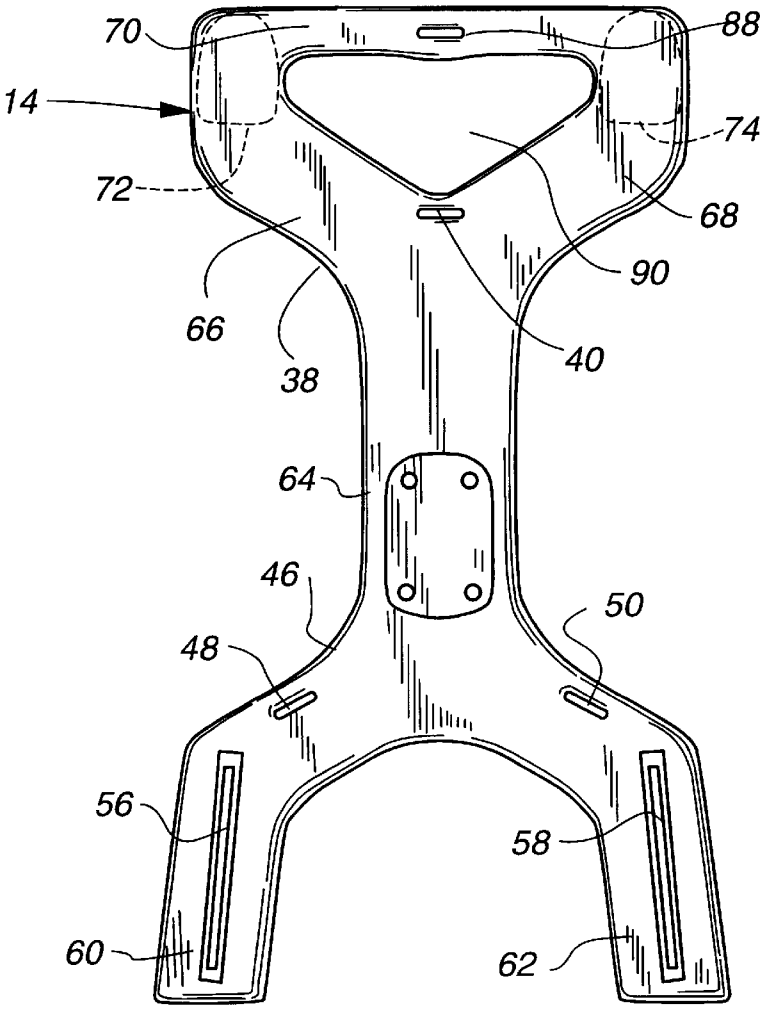
FIG. 5 is a front elevational view of the frame.
Figure 4:
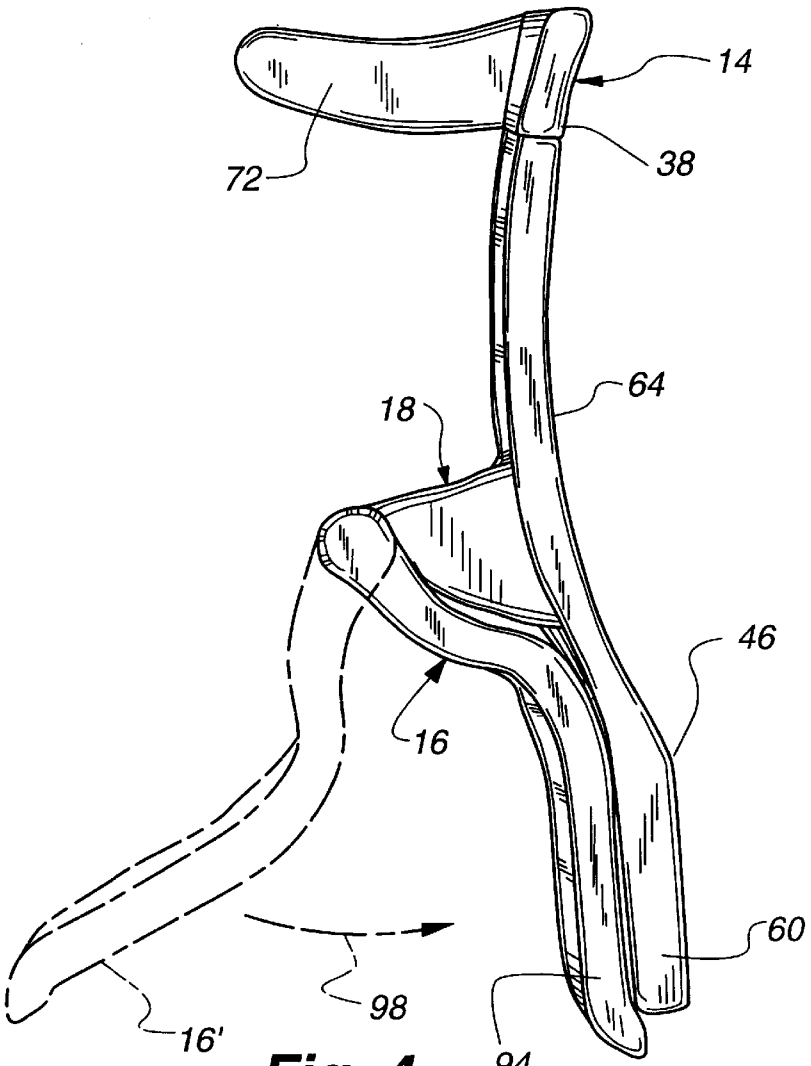
FIG. 4 is a side elevational view of the frame.

Referring to FIGS. 3–5, the frame 14 includes a central spine portion 64 extending between the upper end portion 38 and the lower end portion 46. The upper end portion 38 is formed with a generally triangular shape including upwardly angled arms 66, 68, and a cross bar 70 extending between the arms 66, 68. Rearwardly extending wing portions 72, 74 are attached to rear sides of the arms 66, 68 adjacent to the cross bar 70. The wing portions 72, 74 extend in cantilever relation to the upper end portion 38 substantially perpendicular to the central spine portion 64. The wing portions 72, 74 extend along the sides 24, 26 of the soft body portion 12 and pass through pocket areas 76, 78 (FIGS. 1 and 2) attached to the side portions 24, 26 whereby the side portions 24, 26 and back portion 22 are supported on the frame 14. In addition, a back strap 80 extends around the back portion 22. The back strap 80 may be adjusted to thereby adjust the position of the back portion 22 relative to the front portion 20 to accommodate children of different sizes and limit the movement of a child within the soft body portion 12.

Figure 6:
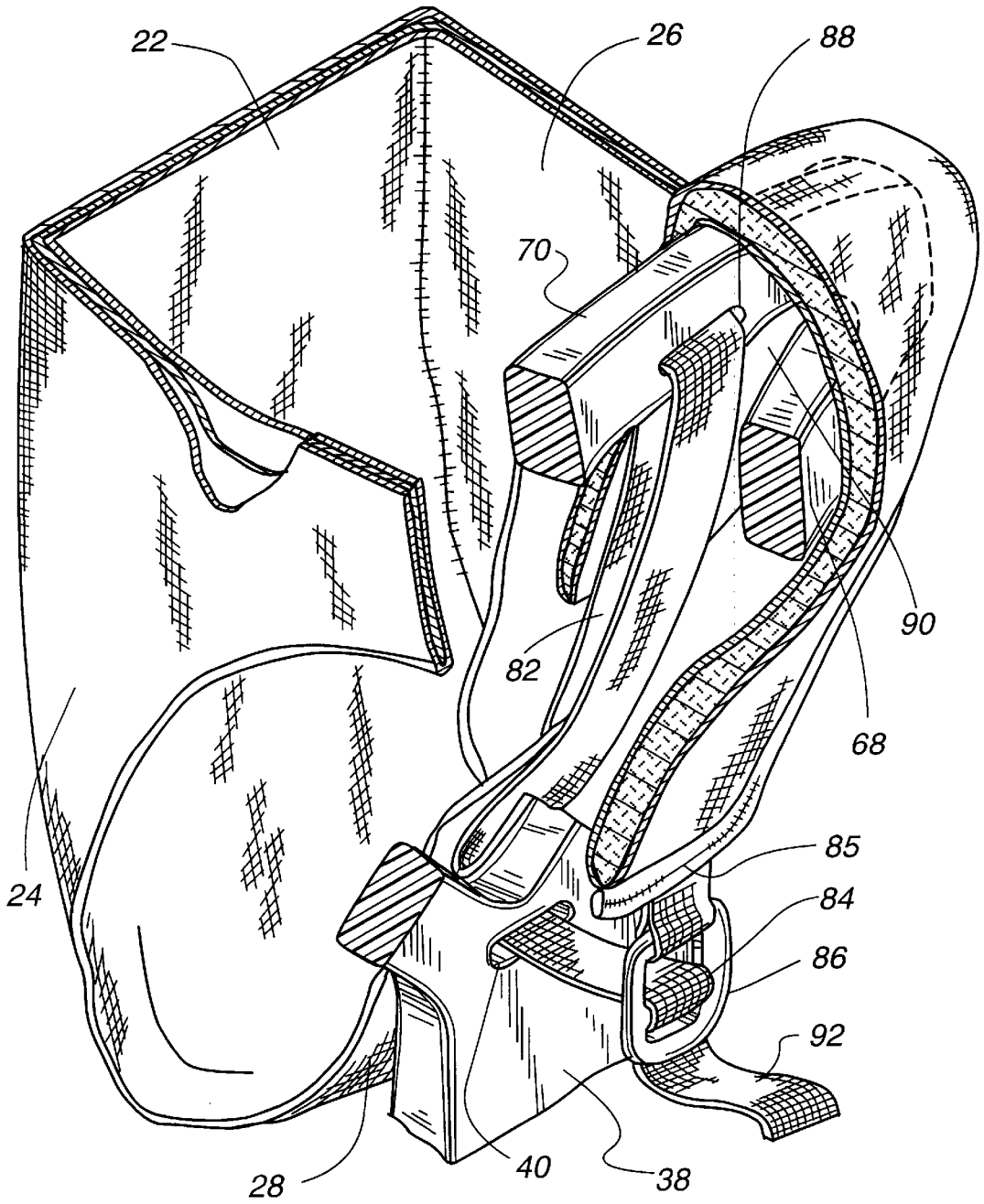
FIG. 6 is a cut-away perspective view of a top portion of the carrier illustrating an adjustment mechanism for the seat portion of the soft body.
Figure 6A:
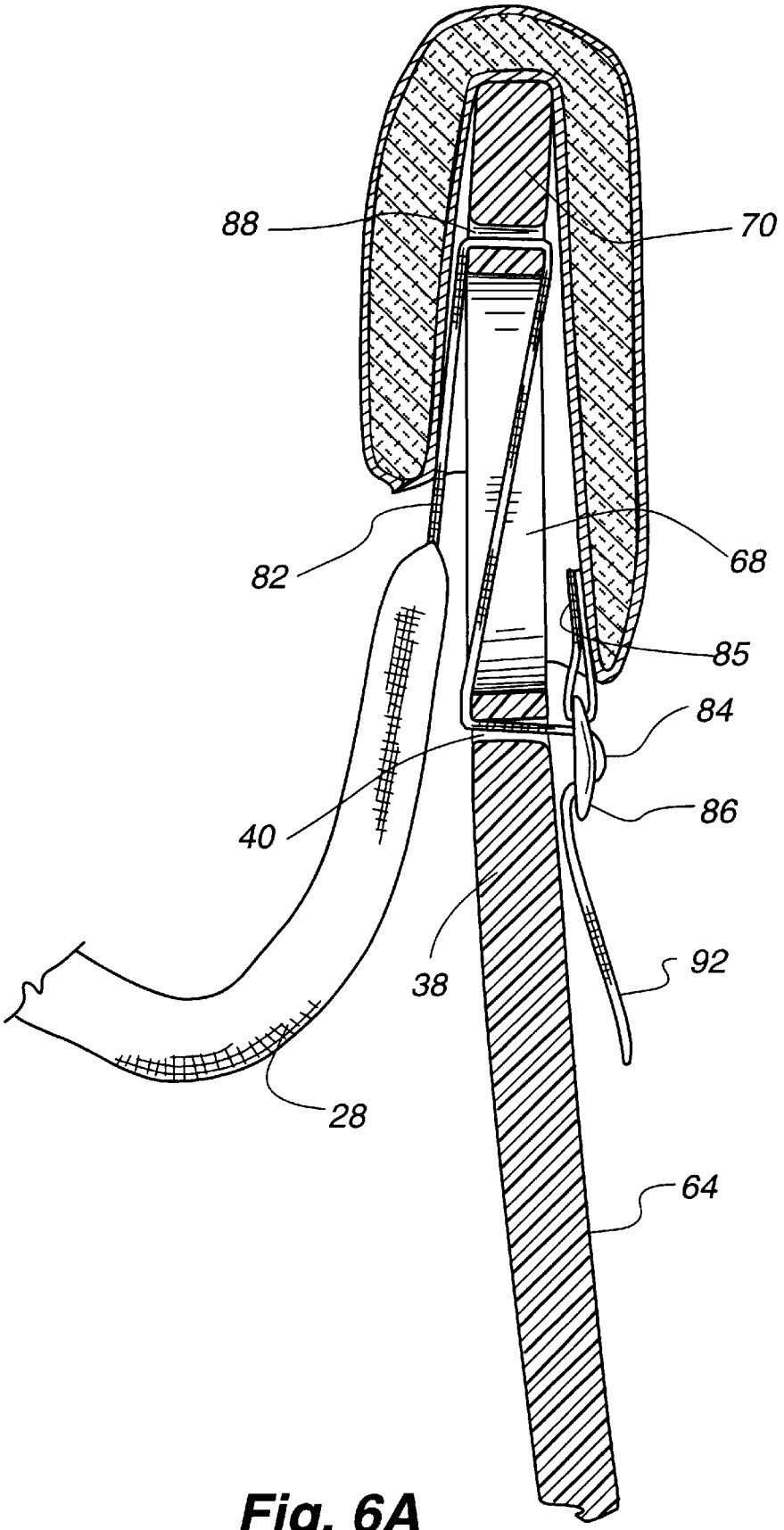
FIG. 6A is a diagrammatic side elevational view of the adjustment mechanism for the seat portion.

Referring to FIGS. 3, 6 and 6A the seat portion 28 for the soft body 12 is provided with an adjustment mechanism including an adjustment strap 82 attached to a forward end of the seat portion 28. An end 84 of the strap 82 is attached to a ladder lock type strap connector 86 which is attached to the frame cover 36 by a short length web 85. An intermediate portion of the adjustment strap 82 is threaded through a slot 88 in the cross bar 70 and passes through a central aperture 90 in the upper end portion 38 and through a slot 40 in the upper portion 38 of the frame 14. After passing through the slot 40, the strap 82 is threaded into the ladder lock 86 in a conventional manner. Pulling on a free end 92 of the adjustment strap 82 will cause the adjustment strap 82 to be drawn through the ladder lock 86 to thereby shorten the length of the intermediate portion of the adjustment strap 82 whereby the height of the seat portion 28 is increased relative to the frame 14. Similarly, loosening the adjustment strap 82 at the ladder lock 86 will cause the height of the seat portion 28 to decrease. In this manner, the seat portion 28 is adapted to accommodate children of different sizes to further limit the movement of a child within the soft body portion 12.

Referring to FIGS. 2 and 4, the leg stand 16 includes a pair of foot members 94, 96 which are adapted to be located in a support position spaced from the lower extensions 60, 62 to support the carrier 10 in an upright position on a horizontal surface. Alternatively, the leg stand 16 may be pivoted to a transport position, as illustrated by arrow 98 in FIG. 4, whereby the foot members 94, 96 are located closely adjacent to the lower extensions 60, 62, respectively. It should be noted that the lower extensions define a Y-shaped structure for the lower end portion 46, and that the foot members 94, 96 define a similar structure for the leg stand 16 whereby the lower extensions 60, 62 and foot members 94, 96 define a stable four point support structure for the carrier when the leg stand 16 is located in the position illustrated by the dotted line 16' in FIG. 4. The leg stand 16 is maintained in either of the two positions shown in FIG. 4 by means of a cam mechanism contained within the hinge extender 18.

Figure 7:
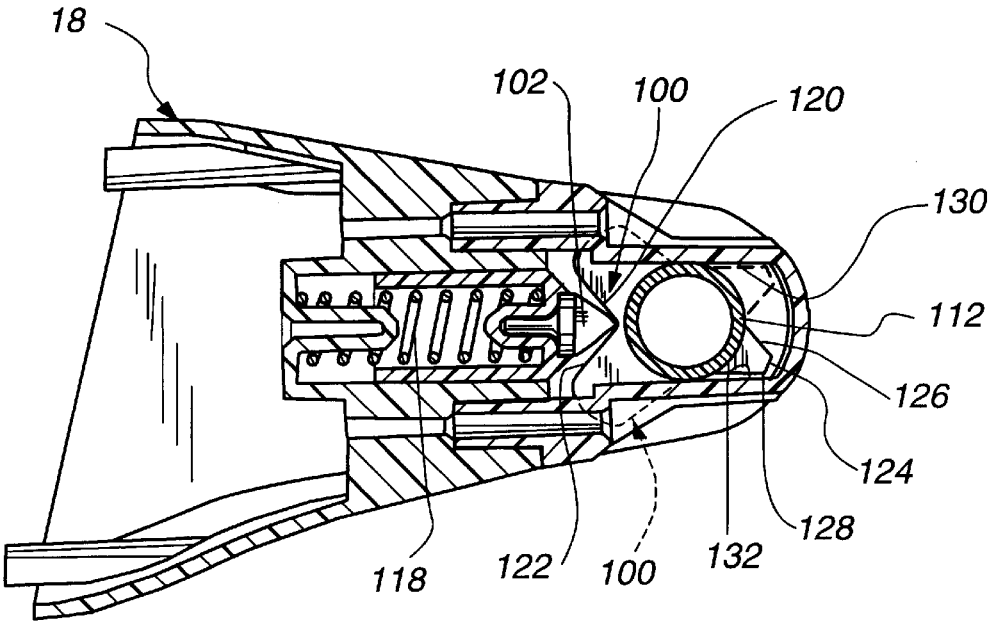
FIG. 7 is a cut-away elevational view taken through the middle of a pivot mechanism for the leg stand of the frame carrier.
Figure 8:
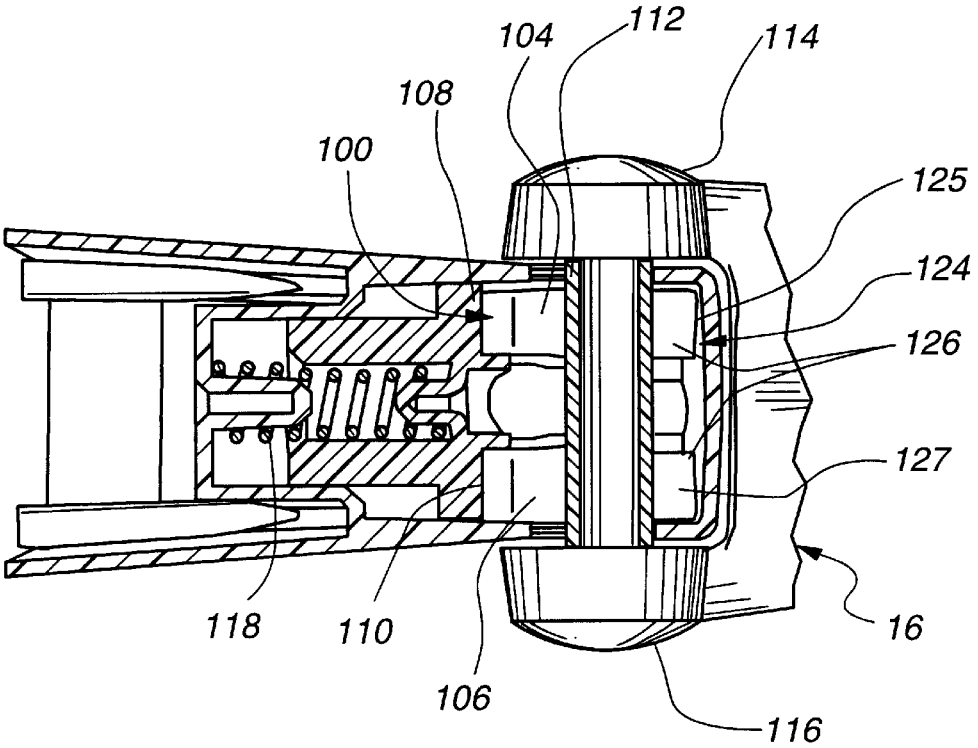
FIG. 8 is a cut-away top plan view taken through the center of the pivot mechanism for the leg stand of the frame carrier.

Referring to FIGS. 7 and 8, the hinge extender is shown in cross section illustrating the pivot connection for pivotally mounting the leg stand 16. The pivot connection generally includes first and second cooperating members comprising a cam 100 and a detent 102 for cooperating with the cam 100. The cam 100 includes a pair of cam lobes 104, 106 for engaging respective lobes 108, 110 of the detent 102. The cam 100 is supported for rotation with a cam shaft 112 and a pair of hubs 114, 116 are located at either end of the cam shaft 112 rigidly attached to an upper extension of the leg stand 16.

The detent 102 is formed as a elongated member mounted for longitudinal movement toward and away from the cam shaft 112. The detent 102 is biased toward the cam shaft 112 by a coil spring 118. Thus, as the leg stand 16 is pivoted from a retracted transport position to its extended support position, the cam 100 will pivot around to the position indicated by 100'. The detent 102 is provided with angled surfaces 120, 122 such that the rounded surface of the cam 100 slide across the surfaces 120, 122 while the detent moves away from and toward the cam shaft 112 during rotation of the cam shaft 112.

In addition, a stop member 124 is located on the cam shaft 112 opposite from the cam 100 and includes a pair of lobes 125, 127 having opposing angled surfaces 126, 128 for engaging respective surfaces 130, 132 within the extender 18. Engagement between the surfaces 126, 128 and 130, 132 provides a positive stop defining two predetermined stop positions for the leg stand 16. Thus, the leg stand 16 is provided with a mechanism for insuring it is positively maintained in one of two positions until a predetermined force is applied to the leg stand 16 to move it to its other position.

Figure 9:
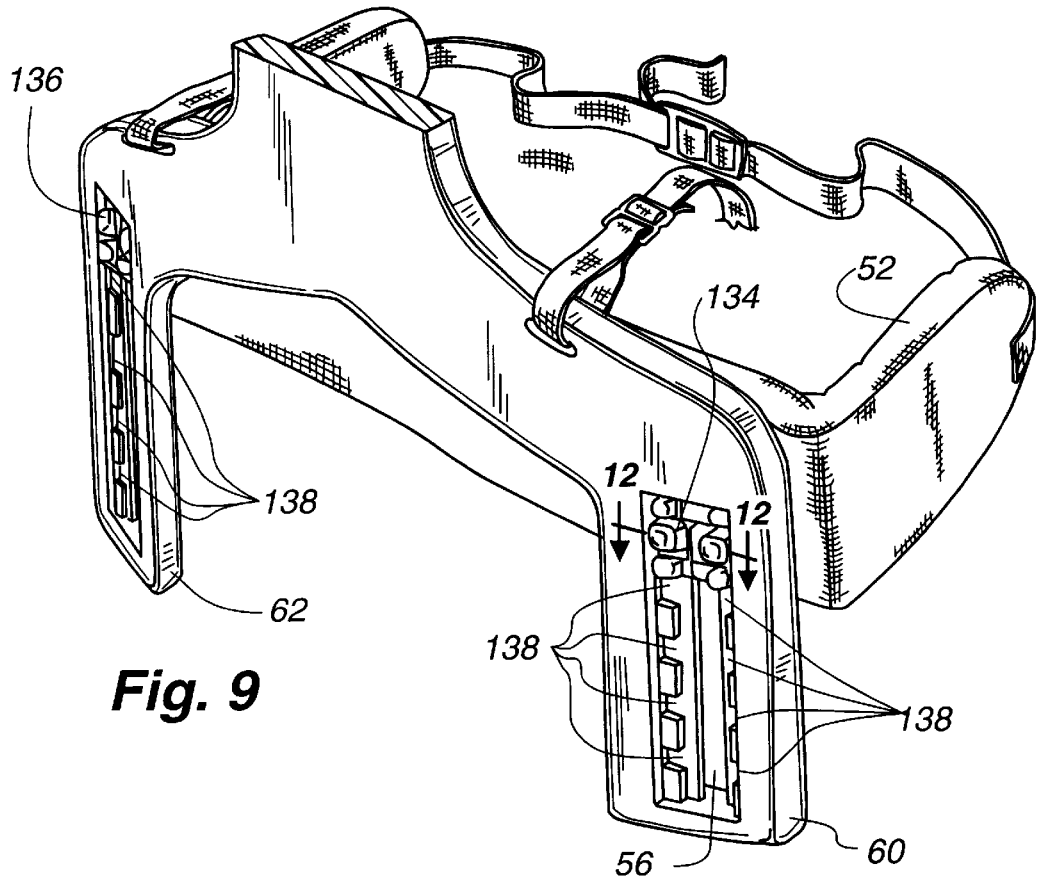
FIG. 9 is a rear perspective view illustrating a vertical adjustment mechanism for the waist belt.

Referring to FIGS. 9–9, the waist belt 52 includes mounting portions in the form of a pair of adjuster clips 134, 136 which are preferably formed of a resilient material such as a plastic resin. The clips 134, 136 are adapted to extend through the slots 56, 58 in the lower extensions 60, 62 to engage a plurality of mounting points defined by recesses 138 formed in rear sides of the lower extensions 60, 62.

Figure 10:
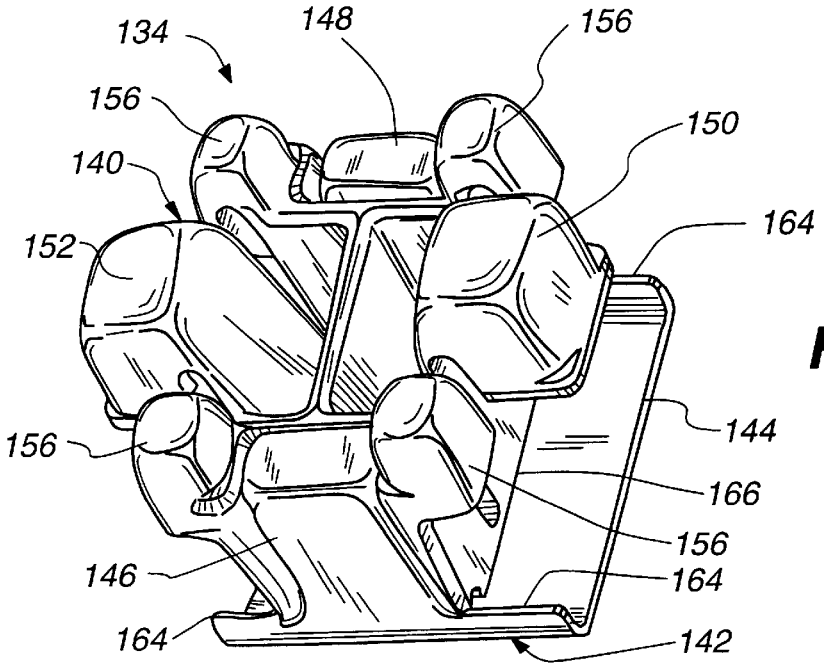
FIG. 10 is a top perspective view of an adjustment clip for the waist belt adjustment mechanism.
Figure 11:
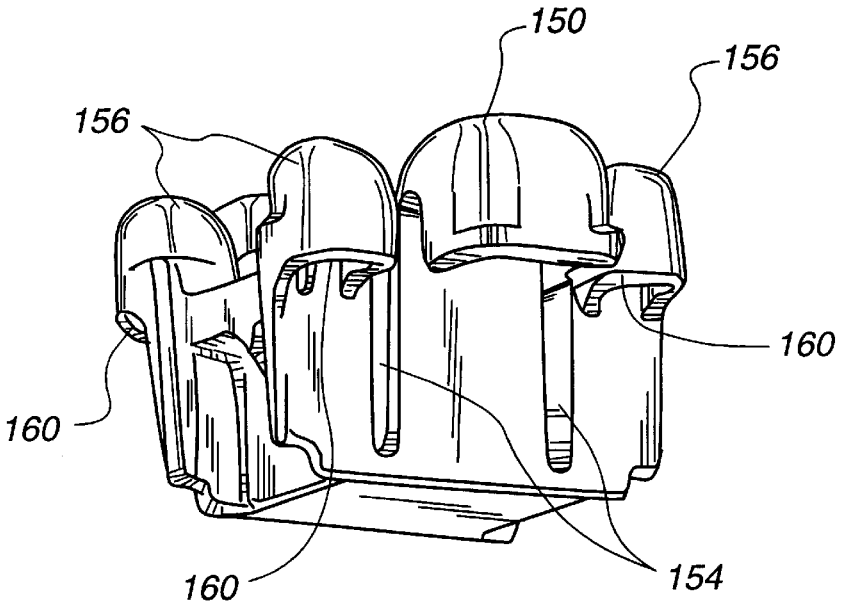
FIG. 11 is a bottom perspective view of a clip body portion of the adjustment clip.

As seen in FIGS. 10 and 11 with reference to the clip 134, each adjuster clip is formed of a clip body 140 and a clip shoe 142. The clip shoe 142 includes a shoe base 144 and connector legs 146, 148 wherein the connector legs 146, 148 snap over opposing ends of the clip body 140 to thereby retain the clip shoe 142 in place on the clip body 140.

The clip body 140 includes a pair of engagement ears 150, 152 wherein each of the ears 150, 152 includes side edges defined by slots 154 cut in the clip body 140. The clip body 140 further includes guide projections 156 wherein a pair of guide projections 156 are located on either side of each of the ears 150, 152.

Figure 12:
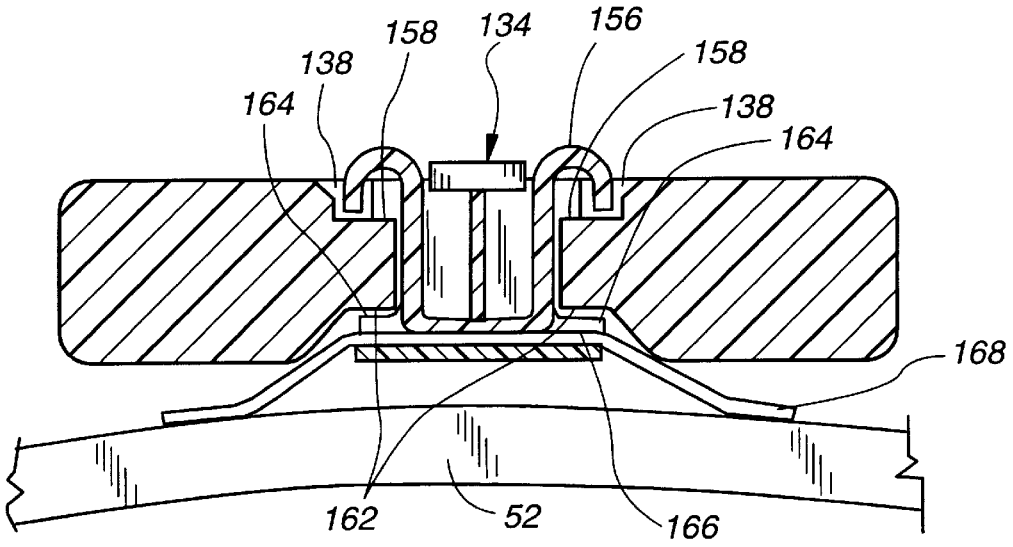
FIG. 12 is a cut-away view of the waist belt adjustment mechanism taken along line 12—12 in FIG. 9.

Referring further to FIG. 12, the slot 56 includes rear guide surfaces 158 for engaging guide surfaces 160 on the projections 156, and front guide surfaces 162 for engaging shoe guide portions 164. Engagement between the surfaces 158, 160 and 162, 164 retain the adjuster clip 134 in position within the slot 156 as the clip 134 slides vertically therethrough. In addition, the ears 150, 152 are adapted to engage within the notches 138 to thereby retain the clip 134 in different predetermined vertical positions within the slot 156. The slots 154 formed in the clip body 140 enable the ears 150, 152 to be supported for resilient movement inwardly toward the center of the body 140 whereby the ears 150, 152 maybe disengaged from the notches 138 to permit vertical movement of the adjuster clip 134.

Further, it should be noted that the clip body 140 and shoe base 144 define a passage 166 for receiving a belt strap 168 therethrough. The belt strap 168 includes opposing ends affixed to the waist belt 52 to thereby hold the waist belt 52 to the clip 134. As previously noted, the clip 136 is provided with a similar structure for supporting the waist belt for vertical adjustment along the slot 58.

The present adjustment structure for the waist belt 52 ensures that the clips 134, 136 remain in engagement within the slots 56, 58 thereby ensuring that the waist belt 52 does not become detached from the lower end portion 46 of the frame 14 during adjustment or use of the waist belt 52. In the preferred embodiment, approximately five adjustment positions are provided for the waist belt.

It should be noted that by providing a waist belt adjustment for the height of the waist belt 52, a wide range of users may be accommodated regardless of the height of the user. Further, it should be noted that the height of the waist belt 52 is adjusted to accommodate different user heights rather than adjusting the height of the shoulder straps 32, 34 such that the position of the carrier 10 on a person's back will be such that the center of gravity of the carrier with a child in it will be close to the center of gravity of the user, regardless of the height of the particular user.

It should be apparent from the above description that the present invention provides a frame carrier having an attractive configuration in that the frame is formed of a resin molded material which may be closely contoured to the body of the user and which is partially covered by a soft body portion supported on the frame. Also, the soft body portion is adapted to accommodate children of various sizes while limiting movement of the child within the soft body portion by providing an easily adjusted seat portion.

Further, a unique configuration for a leg stand is provided wherein the leg stand is movable between two predetermined positions, and the leg stand is provided with means for positively biasing the leg stand into one of its two positions.

In addition, a unique adjustment mechanism is provided for a waist belt of the carrier whereby the waist belt may be adjusted by means of movable clips providing a safe adjustment mechanism for the waist belt while also providing a plurality of convenient preselected locations to which the waist belt may be positioned. In addition, the present waist belt mechanism requires a minimum of manipulation to move the waist belt between positions.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A child carrier for supporting a child on a back of a user, the child carrier comprising:

a soft body portion for supporting a child;

a relatively rigid frame formed of a resin material, said frame including a central spine portion having an upper end portion and a lower end portion, wherein said frame is formed to extend from an upper back portion to a waist portion of a user and said soft body portion is suspended on said frame to support a child, and said frame includes a pair of wing portions formed of said resin material and extending substantially perpendicularly from said upper end portion for supporting said soft body portion, wherein said wing portions extend along opposing sides of said soft body portion in cantilever relation to said upper end portion.

2. A child carrier for supporting a child on a back of a user, the child carrier comprising:

a soft body portion for supporting a child;

a relatively rigid frame formed of a resin material, said frame including a central spine portion having an upper end portion and a lower end portion, wherein said frame is formed to extend from an upper back portion to a waist portion of a user and said soft body portion is suspended on said frame to support a child, and said frame includes a pair of wing portions formed of said resin material and extending substantially perpendicularly from said upper end portion for supporting said soft body portion; and a leg stand formed of said resin material, and including a pivot mechanism mounting said leg stand to said frame for pivotal movement.

3. A carrier adapted to be carried on a back of a user, said carrier comprising:

a soft body portion for supporting a child;

a frame including an upper end portion and a lower end portion, wherein said soft body portion is suspended on said frame to support a child;

shoulder straps extending from a location adjacent to said upper end portion;

a waist belt including mounting portions; and a plurality of mounting points defined on said lower end portion, said mounting portions of said waist belt engaging said mounting points;

wherein said mounting points define a plurality of different vertical positions for receiving said mounting portions of said waist belt, wherein said mounting points include a pair of elongated slots defined in said lower end and said mounting portions of said waist belt extend through said slots;

whereby a vertical position of said waist belt is adjusted relative to said lower end portion.

4. The carrier as recited in claim 3 wherein said mounting portions of said waist belt include clips movably engaged within said slots and including means provided along said slots defining predetermined locations for receiving said clips.

5. A carrier adapted to be carried on a back of a user, said carrier comprising:

a soft body portion for supporting a child;

a frame including a central spine portion defining an upper end portion and a lower end portion, wherein said soft body portion is suspended on said frame to support a child, wherein said frame includes a pair of wing portions extending in a rearward direction from said frame for supporting said soft body portion;

shoulder straps extending from a location adjacent to said upper end portion;

a waist belt including mounting portions; and a plurality of mounting points defined on said lower end portion, said mounting portions of said waist belt engaging said mounting points;

wherein said mounting points define a plurality of different vertical positions for receiving said mounting portions of said waist belt;

whereby a vertical position of said waist belt is adjusted relative to said lower end portion.

6. A carrier adapted to be carried on a back of a user, said carrier comprising:

a soft body portion for supporting a child;

a frame including a central spine portion defining an upper end portion and a lower end portion, wherein said soft body portion is suspended on said frame to support a child;

a leg stand having a pivot mechanism pivotally attaching said leg stand to said frame;

shoulder straps extending from a location adjacent to said upper end portion;

a waist belt including mounting portions; and a plurality of mounting points defined on said lower end portion, said mounting portions of said waist belt engaging said mounting points;

wherein said mounting points define a plurality of different vertical positions for receiving said mounting portions of said waist belt;

whereby a vertical position of said waist belt is adjusted relative to said lower end portion.

7. A child carrier for supporting a child on a back of a user, said carrier comprising:

a soft body portion, said soft body portion including a front portion, a back portion, side portions connecting said front portion and said back portion, and a seat portion connected to said back portion for supporting a child;

a substantially rigid frame including an upper end and a lower end, said frame supporting said soft body portion; and an adjustment strap extending between said seat portion and said frame for adjusting a height of said seat portion relative to said frame.

8. The carrier as in claim 7 wherein said frame includes a slot formed through said upper end and said adjustment strap passes through said slot.

9. The carrier as in claim 7 wherein a length of said adjustment strap between said seat portion and said frame is adjustable such that decreasing said length increases the height of said seat portion, and increasing said length decreases the height of said seat portion.

10. The carrier as in claim 7 wherein said frame includes wing portions extending along said side portions in cantilever relation to said upper end for supporting said side portions and said back portion.

11. The carrier as in claim 7 wherein said frame is formed of a resin material.

12. The carrier as in claim 7 including shoulder straps extending from a location adjacent to said upper end portion and a waist belt attached to said lower end portion.

13. A carrier adapted to be supported on a back of a user, said carrier comprising:

a soft body portion;

a relatively rigid frame supporting said soft body portion;

a leg stand for supporting said frame in an upright position on a horizontal surface;

a pivot connection attaching said leg stand to said frame for pivotal movement, said pivot connection including first and second cooperating members, one of said cooperating members being mounted for pivoting movement with said leg stand and the other of said cooperating members engaging said one of said cooperating members to thereby define two predetermined positions for said leg stand; and wherein said frame includes a central spine portion having an upper end portion and a lower end portion, said lower end portion defining a bifurcated structure for supporting said frame at laterally spaced locations when said leg stand supports said frame in an upright position on a horizontal surface.

* * * * *